US006924449B2

(12) United States Patent
Duchemin et al.

(10) Patent No.: US 6,924,449 B2
(45) Date of Patent: Aug. 2, 2005

(54) INTERRUPTING DEVICE FOR SWITCHING APPARATUS

(75) Inventors: Pierre Duchemin, Fourqueux (FR); Bruno Jacquet, Mantes la Ville (FR); Gilles Baurand, Montesson la Borde (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 0 days.

(21) Appl. No.: 10/363,258

(22) PCT Filed: Sep. 7, 2001

(86) PCT No.: PCT/FR01/02779

§ 371 (c)(1),
(2), (4) Date: Jul. 28, 2003

(87) PCT Pub. No.: WO02/21550

PCT Pub. Date: Mar. 14, 2002

(65) Prior Publication Data

US 2004/0031668 A1 Feb. 19, 2004

(30) Foreign Application Priority Data

Sep. 8, 2000 (FR) ..... 00 11556

(51) Int. Cl.[7] ..... H01H 13/12
(52) U.S. Cl. ..... 200/531; 200/243; 200/16 A
(58) Field of Search ..... 200/520, 530–536, 200/341, 435, 16 A–16 D, 16 R, 243, 434, 86.5

(56) References Cited

U.S. PATENT DOCUMENTS

| | | | | | |
|---|---|---|---|---|---|
| 2,532,305 | A | | 12/1950 | Heller | |
| 4,154,996 | A | | 5/1979 | Arnold | |
| 5,201,410 | A | * | 4/1993 | Takano et al. | 200/531 |
| 5,283,406 | A | * | 2/1994 | Olsen | 200/243 |
| 5,635,886 | A | * | 6/1997 | Pichard | 335/132 |
| 5,886,602 | A | * | 3/1999 | Burel et al. | 200/243 |
| 6,326,570 | B1 | * | 12/2001 | Fujii et al. | 200/520 |
| 6,556,110 | B1 | * | 4/2003 | Niebler et al. | 200/245 |

FOREIGN PATENT DOCUMENTS

| | | |
|---|---|---|
| DE | 198 18 058 | 11/1999 |
| GB | 1 080 279 | 8/1967 |

* cited by examiner

*Primary Examiner*—Lincoln Donovan
*Assistant Examiner*—M. Fishman
(74) *Attorney, Agent, or Firm*—Oblon, Spivak, McClelland, Maier & Neustadt, P.C.

(57) ABSTRACT

A contact pole interrupting device in an electrical switching apparatus composed of a moving contact holder including a cylindrical contact pressure spring, a slide that moves along a longitudinal axis, and a mobile bridge supporting two mobile contacts. The mobile bridge has a central opening in which are inserted two protuberances belonging to the slide and equipped with an outer pin enabling the slide to be clamp-mounted on the mobile bridge. An end of the spring, which rests on the mobile bridge, is kept in a place by a flange on side ends of the slide and is centered by the protuberances of the slide.

19 Claims, 2 Drawing Sheets

INTERRUPTING DEVICE FOR SWITCHING APPARATUS

BACKGROUND OF THE INVENTION

1. Field of the Invention

This invention regards interrupting device for a contact pole in an electrical switching apparatus such as a circuit breaker, a contactor, a switch or a contactor-breaker, comprising a moving contact holder with a slide clamp-mounted on a mobile bridge supporting the mobile contacts. The invention also regards an electrical apparatus equipped with at least one such interrupting device.

2. Description of the Related Art

In a known electrical apparatus, the contact pole interrupting device comprises a moving contact holder, usually composed of a slide that moves along an axis between a rest position and a work position. The slide can be controlled by manual mechanisms, by magnetic and/or thermal tripping mechanisms in the event of an electrical fault. Its function is to mechanically displace a mobile bridge supporting the mobile contacts. This displacement causes the mobile contacts and the fixed contacts to separate, which corresponds to the rest position. In the work position, the mobile contacts are usually held against the fixed contacts by a contact pressure spring.

A switching apparatus contact pole is described in document DE19818058. It comprises a slide in which a mobile contact bridge is held in a opening in the slide by means of a contact spring. However, the slide does not have any special means to mount it on the mobile bridge without the contact spring.

Furthermore, in document U.S. Pat. No. 4,154,996 regarding a mechanical detector or limit switch, a mobile bridge is clamp-mounted in a piston (or slide) by a central opening in the mobile bridge. However, the contact pressure of the mobile bridge contacts on the fixed contacts is only transmitted by this clamp-mounting, which makes this solution unsuitable for a switching apparatus such as a circuit breaker, a contactor or a contactor-breaker, in which the electric currents circulating between the contacts are likely to be much greater than in a detector. Indeed, if there should be any wear play in the clamp-mounting at the end of a period of use, there is a risk of having a passage during the opening or closing of the contacts where the electrical contact will not exert any real pressure on the contacts, which would be redhibitory for the use described in this invention, on account of risks of fusion in particular.

SUMMARY OF THE INVENTION

The aim of the invention is to propose a simple solution for mounting the slide on the mobile bridge, and to reduce the dimensions of such a interrupting device while at the same time keeping the contact pressure spring as large as possible to ensure the proper operation of the spring. The mounting must also be flexible enough to obtain a contact pressure that is correctly divided between the mobile contacts.

To this end, the invention submits a switching apparatus interrupting device composed of a moving contact holder comprising a contact pressure spring, a slide that moves along a longitudinal axis between a work position and a rest position, and a mobile bridge with a lower face and an upper face supporting two mobile contacts. A particular feature of the interrupting device is that the mobile bridge has a central opening in which is inserted at least one protuberance belonging to the slide and comprising clamp-mount means to clamp-mount the slide on the mobile bridge. Another characteristic is that the contact pressure spring has a first end which rests on the lower face of the mobile bridge.

The slide has stop means to stop the mobile bridge, consisting of a face to hold the slide that cooperates with the upper face of the mobile bridge, and side ends on the slide that fit around the side faces of the mobile bridge. The clamp-mounting means and stop means are arranged to allow the mobile bridge sufficient play in a direction roughly perpendicular to the longitudinal axis of the slide, so that in the work position the contact pressure spring can exert pressure on the mobile bridge to be able to hold the mobile contacts of the mobile bridge against the corresponding fixed contacts of the switching apparatus.

BRIEF DESCRIPTION OF THE DRAWINGS

Other characteristics and advantages will be seen in the detailed description below, with reference to an embodiment of the invention given as an example and represented by the attached drawings in which.

DETAILED DESCRIPTION

Figure 1:
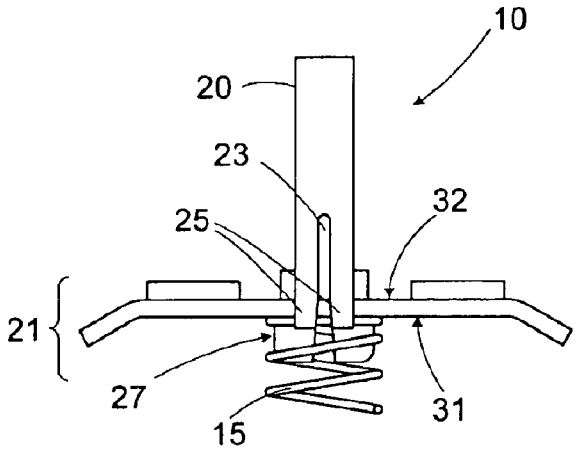
- FIG. 1 shows a front view of a moving contact holder with a slide, a mobile bridge supporting two mobile contacts and a contact pressure spring.
Figure 2:
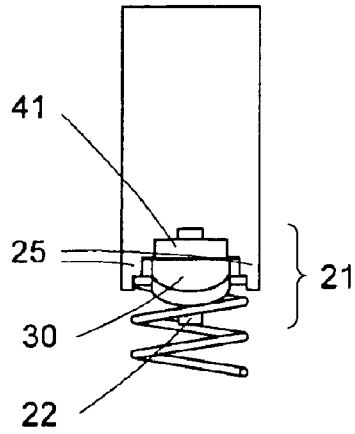
- FIGS. 2 and 3 show the same moving contact holder seen respectively from the front and from below.
Figure 4:
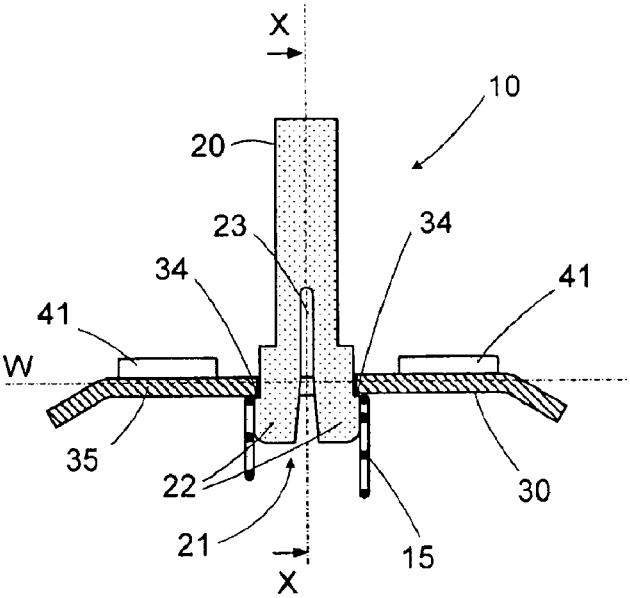
- FIGS. 4 and 5 are views of the moving contact holder in cross-section according to a Y—Y plane and a X—X plane respectively.

With reference to FIGS. 1 and 4, the contact pole interrupting device described in this invention comprises a moving contact holder 10 consisting of:

- a slide 20 that can be displaced between a work position and a rest position along a longitudinal axis X,
- a mobile bridge 30 arranged along a transverse axis W roughly perpendicular to the axis X and comprising a lower face 31, an upper face 32 and side faces 35,
- a contact pressure spring 15 of a roughly cylindrical shape, with the first end 16 resting on the lower face 31 of the mobile bridge 30 and a second opposite end 17 resting on a base 12 of the switching apparatus,
- two mobile contacts 41 mounted on the upper face 32 of the mobile bridge 30, each side of the slide 20.

In the work position, the mobile contacts 41 are held directly against the corresponding fixed contacts 42 of the switching apparatus by the contact pressure spring 15. In the rest position, the mobile contacts 41 are separated from the fixed contacts 42 by the slide 20 which is mechanically attached to the mobile bridge 30.

In the embodiment shown, the slide 20 comprises a low part 21 with the various components enabling the mobile bridge 30 to be mounted on the slide 20. The low part 21 comprises at least one protuberance 22 equipped with the clamp-mount means the slide on the mobile bridge. In the preferred embodiment, these clamp-mounting means consist of at least one outer pin 34.

With reference to FIGS. 1 and 4, the low part 21 of the slide 20 comprises two protuberances 22 whose opposite external faces 27 are each equipped with an outer pin 34. The lower part of these external faces 27 has a rounded edge.

The two protuberances 22 are separated by a central groove 23 made in the slide 20. The slide is preferably made of an isolating plastic material so that the central groove 23 is sufficient to give elasticity to the outer pins 34 of the protuberances 22 in a direction that is roughly perpendicular to the axis X.

The mobile bridge 30 comprises a central opening 33, which may be rectangular in shape. To mount the mobile bridge 30 on the slide 20, the protuberances 22 of the slide are inserted in the central opening 33 of the mobile bridge 30. During this insertion, the rounded edges of the external walls 27 of the protuberances 22 are thrust against the edges of the central opening 33 which forces the outer pins 34 towards each other, until they come under the lower face 31 of the mobile bridge 30. The elasticity of the two protuberances 22 then returns them to their initial position and the outer pins 34 are supported against the lower face 31, thus locking together the mobile bridge 30 and the slide 20. The mounting operation is thus very simple and does not need any additional parts, making it fast and economical to implement.

Figure 5:
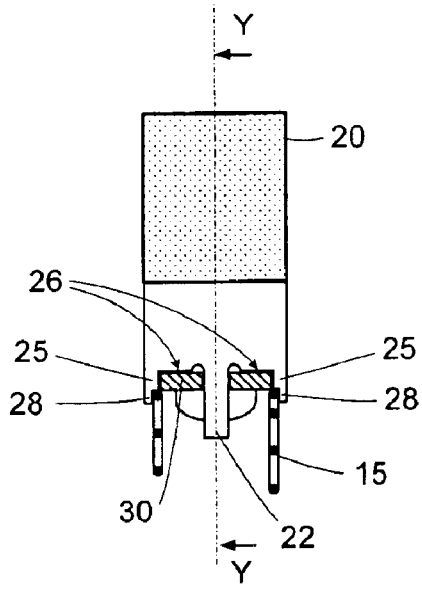
Figure 6:
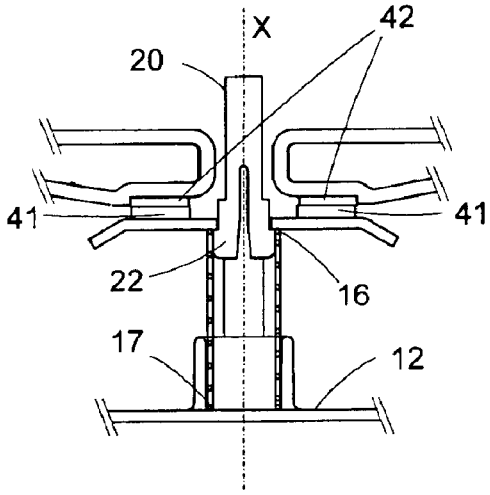
- FIG. 6 represents a contact pole interrupting device in the work position according to the invention.

The slide also has means to stop the mobile bridge 30 to ensure it is kept in place. With reference to FIG. 5, these stop means consist of an internal holding face 26 fitted in slide 20 which cooperates with the upper face 32 of the mobile bridge 30 in such a way that the holding face 26 drives the mobile bridge 30 along the longitudinal axis X when changing from the work position to the rest position. The end stops also comprise side ends 25 located on the low part 21 of the slide and which fit round the side faces 35 of the mobile bridge 30 to keep the latter in position along a transverse axis Z (see FIGS. 3 and 5).

Figure 3:
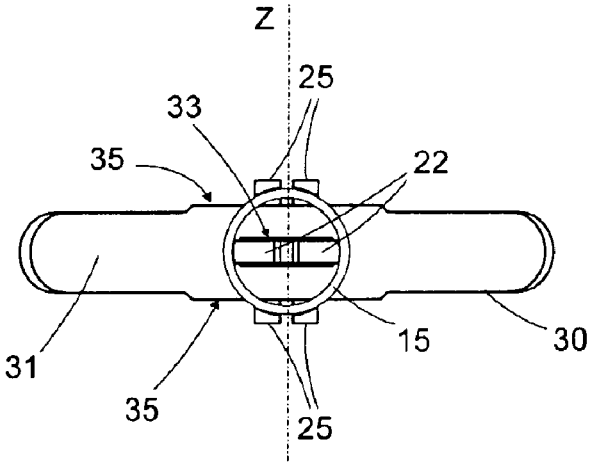

With reference to FIG. 3, the low part 21 of the slide 20 comprises four side ends 25: an end for each side along the transverse axis Z, each end on the same side being separated in two by the central groove 23. As the side ends 25 do not contribute to the mechanical effort between the mobile bridge 30 and the slide 20 when the slide is displaced, the size of these ends 25 can therefore be reduced to the minimum that is compatible with the casting and machining requirements for industrial manufacturing and compatible with legislative requirements (a thickness of the ends 25 of about 0.5 mm is typically sufficient). This has the advantage of reducing the overall dimensions of the contact pole and thus optimising the dimensions of the switching apparatus.

The contact pressure spring 15 rests directly on the mobile bridge 30 (via the lower face 31) in such a way as to create sufficient contact force between the fixed contacts 42 and the mobile contacts 41 in the work position. The clamp-mountings do not therefore play any part in the pressure force of the contacts, so that wear and tear due to a long period of use of the device and which is liable to generate some play on these clamp-mountings will not affect the quality of the contact pressure. For improved resistance and improved efficiency of the spring 15, the section of the contact pressure spring 15 should be as large as possible and the spring 15 should be cylindrical rather than conical in shape. For this reason, the first end 16 of the spring 15 is kept in position by the flanges 28 fitted on each side end 25 of the slide 20, as shown in FIG. 5. These flanges 28 are as thin as possible so as to allow a significant circular section to the spring 15, thus allowing the contact pressure spring 15 to have a cylindrical shape, without however compromising the overall dimensions of the slide. Moreover, for a better stability of the spring 15, the protuberances 22 of the slide 20 provide a simple means of ensuring that the first end 16 of the spring 15 is centred in relation to the mobile bridge 30, since the first end 16 is held against the external walls 27 of these protuberances 22.

As shown in FIG. 5, the spring 15 also contacts a lower portion of the slide 20.

The means of clamp-mounting and holding on the slide 20 have an important characteristic, being arranged in such a way that the mobile bridge 30 can have a play between the outer pins 34 and the holding face 26, regardless of the action of the spring 15. This play develops roughly along the longitudinal axis X of the slide 20. In the work position, it allows the spring 15 to exert sufficient pressure on the mobile bridge 30 to hold the two mobile contacts 41 of the mobile bridge 30 simultaneously and uniformly against the corresponding two fixed contacts 42. In fact, if the alignment or the thickness of the fixed contacts 42 or the mobile contacts 41 are not exactly the same, the mobile bridge 30 rigidly mounted on the slide 20 would cause the two pairs of contacts 41,42 to open or close in a way which would not be entirely simultaneous, nor made with the same force, and could therefore lead either to a faulty electrical contact or to the rapid deterioration of the contacts. Thanks to this play, the mobile bridge 30 can lean slightly to one side or the other in relation to its transverse axis W in such a way to make up for any imperfection of the contacts and to ensure that the contacts close with the same pressure and open simultaneously. This avoids the risk of overheating, fusion or deterioration of the contacts that could happen over time, after intensive use of the interrupting device.

As shown in the drawings, a constant distance is maintained between the lower face 31 and the upper face 32 of the mobile bridge 30, as the lower face 31 does not move relative to the upper face 32, such as during movement of the moving contact holder 10 between work and rest positions.

Other variations and improvements to details can of course be envisaged, including the use of equivalent means, while still remaining within the framework of the invention.

What is claimed is:

1. Interrupting device for a contact pole in an electrical switching apparatus, including a moving contact holder, comprising:

a contact pressure spring;

a slide configured to move along a longitudinal axis between a work position and a rest position; and a mobile bridge having a lower face opposite an upper face that supports two mobile contacts, the lower and upper faces maintaining a constant distance from one another during movement of the slide between the work and rest positions, wherein the mobile bridge includes a central opening into which is inserted at least one protuberance of the slide comprising means for clamp-mounting the slide onto the mobile bridge, and wherein the contact pressure spring includes a first end that rests on the lower face of the mobile bridge.

2. Interrupting device according to claim 1, wherein the means for clamp-mounting comprises at least one supporting face on the at least one protuberance of the slide which is configured to support the lower face of the mobile bridge when the slide is mounted on the mobile bridge.

3. Interrupting device according to claim 2, wherein the at least one protuberance comprises two protuberances including supporting faces.

4. Interrupting device according to claim 3, wherein the two protuberances of the slide are separated by a central groove in the slide configured to permit displacement of the supporting faces of the protuberances in a direction roughly perpendicular to the longitudinal axis of the slide.

5. Interrupting device according to claim 3, wherein the slide comprises stop means for stopping the mobile bridge, the stop means including a holding face configured to cooperate with the upper face of the mobile bridge.

6. Interrupting device according to claim 3, wherein the contact pressure spring comprises a roughly cylindrical shape and has a second end opposite the first end configured to contact a base of the electrical switching apparatus.

7. Interrupting device according to claim 6, wherein the first end of the contact pressure spring is configured to be disposed within a flange disposed on side ends of the slide.

8. Interrupting device according to claim 7, wherein the first end of the contact pressure spring is disposed to surround the protuberances of the slide.

9. Interrupting device according to claim 5, wherein the clamp-mounting means and the stop means are configured to permit the contact pressure spring to exert uniform and simultaneous pressure to hold the two mobile contacts of the mobile bridge against two fixed contacts of the switching apparatus.

10. Electrical switching apparatus comprising the interrupting device according to claim 1.

11. A movable contact configured to be used in an electrical switching apparatus, comprising:

a slide configured to move along an axis;

a bridge comprising top and bottom faces, the top face including a first contact configured to achieve electrical connection with a second contact, the top and bottom faces maintaining a constant distance therebetween throughout an entire range of movement of the slide along the axis; and a resilient member contacting the bottom face of the bridge and a lower portion of the slide, the resilient member configured to hold the bridge in contact with the slide.

12. The movable contact according to claim 11, wherein the bridge defines a void, and the slide is disposed within the void.

13. A movable contact configured to be used in an electrical switching apparatus, comprising:

a slide configured to move along an axis;

a bridge comprising ton and bottom faces, the top face including a first contact configured to achieve electrical connection with a second contact, the top and bottom faces maintaining a constant distance therebetween throughout an entire range of movement of the slide along the axis; and a resilient member contacting the bottom face of the bridge and configured to hold the bridge in contact with the slide, wherein the slide comprises a protuberance and a stop configured to retain the bridge therebetween.

14. The movable contact according to claim 13, wherein the void is configured to receive the protuberance therethrough.

15. The movable contact according to claim 14, wherein the protuberance is configured to be elastically deformed to permit the protuberance to be disposed through the void.

16. The movable contact according to claim 14, wherein the protuberance is configured to be elastically deformed to retain the bridge between the protuberance and the stop.

17. The movable contact according to claim 16, wherein the protuberance comprises a pair of protuberance.

18. The movable contact according to claim 17, wherein the resilient member contacts the bridge.

19. The movable contact according to claim 18, wherein the resilient member comprises a spring.

* * * * *